US008864368B2

(12) United States Patent
Dubois

(10) Patent No.: US 8,864,368 B2
(45) Date of Patent: Oct. 21, 2014

(54) INDICATOR OF THE POWER RESERVE OF A TIMEPIECE

(75) Inventor: Cyril Dubois, La Chaux-de-Fonds (CH)

(73) Assignee: Milus International S.A. (CH)

( * ) Notice: Subject to any disclaimer, the term of this patent is extended or adjusted under 35 U.S.C. 154(b) by 104 days.

(21) Appl. No.: 13/699,645

(22) PCT Filed: Jun. 6, 2011

(86) PCT No.: PCT/IB2011/001222

§ 371 (c)(1),
(2), (4) Date: Nov. 23, 2012

(87) PCT Pub. No.: WO2011/151717

PCT Pub. Date: Dec. 8, 2011

(65) Prior Publication Data

US 2013/0077452 A1 Mar. 28, 2013

(30) Foreign Application Priority Data

Jun. 4, 2010 (CH) ..... 0977/10
Jun. 30, 2010 (CH) ..... 1056/10

(51) Int. Cl.
*G04B 47/06* (2006.01)
*G04B 9/02* (2006.01)
*G04B 21/00* (2006.01)

(52) U.S. Cl.
CPC ..... *G04B 47/06* (2013.01); *G04B 9/025* (2013.01); *G04B 21/00* (2013.01)
USPC ..... 368/211; 368/206

(58) Field of Classification Search
CPC ..... G04B 9/00; G04B 9/005; G04B 9/025; G04B 9/02; G04C 10/04; G04C 10/00
USPC ..... 368/206, 210–212, 243, 249
See application file for complete search history.

(56) References Cited

U.S. PATENT DOCUMENTS

| | | | | |
|---|---|---|---|---|
| 198,268 | A * | 12/1877 | Bergstrom | 368/211 |
| 240,090 | A * | 4/1881 | Chase | 368/211 |
| 741,647 | A * | 10/1903 | Fisher | 368/211 |
| 833,657 | A * | 10/1906 | Arneson | 368/211 |
| 2,670,592 | A * | 3/1954 | Jeanneret | 368/210 |
| 4,180,970 | A * | 1/1980 | Tokunaga et al. | 368/243 |
| 7,614,784 | B2 * | 11/2009 | Watanabe | 368/210 |
| 7,681,285 | B2 * | 3/2010 | Hua | 16/422 |
| 2007/0041277 | A1 * | 2/2007 | Gerber et al. | 368/210 |
| 2008/0192585 | A1 * | 8/2008 | Corthesy et al. | 368/268 |
| 2009/0129211 | A1 * | 5/2009 | Rochat | 368/208 |
| 2010/0046330 | A1 * | 2/2010 | Papi et al. | 368/243 |
| 2011/0182152 | A1 * | 7/2011 | Jouvenot | 368/212 |

FOREIGN PATENT DOCUMENTS

| | | |
|---|---|---|
| CH | 336760 | 2/1959 |
| EP | 1909149 | 4/2008 |

* cited by examiner

*Primary Examiner* — Amy Cohen Johnson
*Assistant Examiner* — Matthew Powell
(74) *Attorney, Agent, or Firm* — Galbreath Law Offices, P.C.; John A. Galbreath

(57) ABSTRACT

Watch movement of a mechanical or automatic watch comprising an indicator device for the power reserve which is configured to enable the power reserve to be indicated on demand. The device includes means to produce an acoustic signal that indicates the amplitude of the power reserve when said means are actuated.

6 Claims, 2 Drawing Sheets

INDICATOR OF THE POWER RESERVE OF A TIMEPIECE

The present invention relates to the field of watchmaking and more particularly to an indicator for the power reserve of a mechanical or automatic watch.

The prior art already includes numerous devices that allow the power reserve of a mechanical or automatic watch to be displayed. In general, these devices allow the power reserve to be displayed continuously. For this purpose, the power reserve indicator body is attached to a wheel interlocking with a differential gear train with the barrel and the ratchet of the watch movement.

Mechanisms also exist that allow selection of a function to be displayed at any given time. EP1922591, for example, proposes a watch mechanism that allows an indication of choice to be displayed in a window, the indication being chosen among in particular the day, the week, the year and the power reserve.

The aim of the present invention is to propose another method of indicating the power reserve in a creative way.

In accordance with the invention, this aim is achieved thanks to watch movement of a mechanical or automatic watch comprising a device indicating the power reserve which is configured in a way to allow indication of the power reserve on demand. The device has the means to produce an acoustic signal that indicates the amplitude of the power reserve when said means are actuated.

Figure 1:
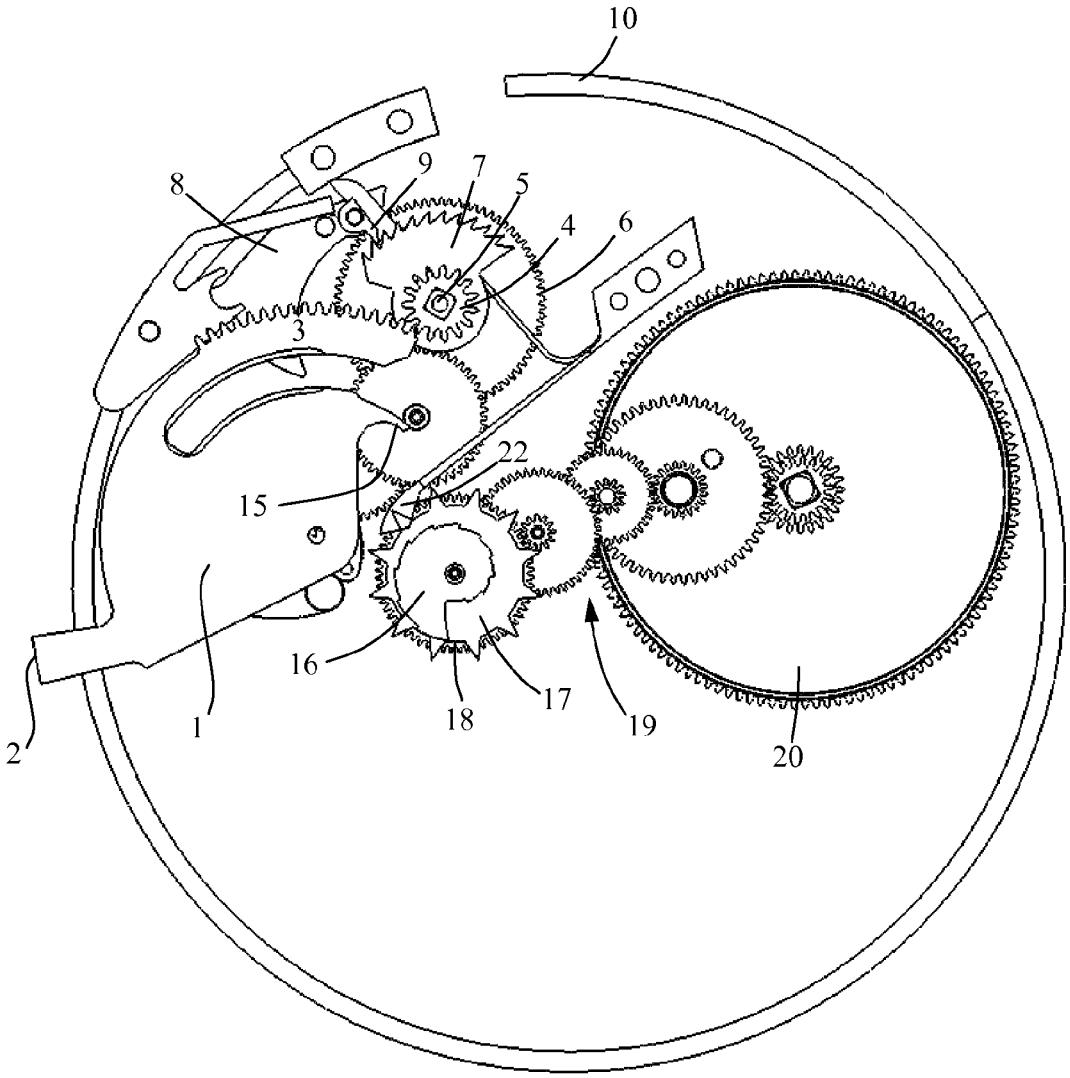
Figure 2:
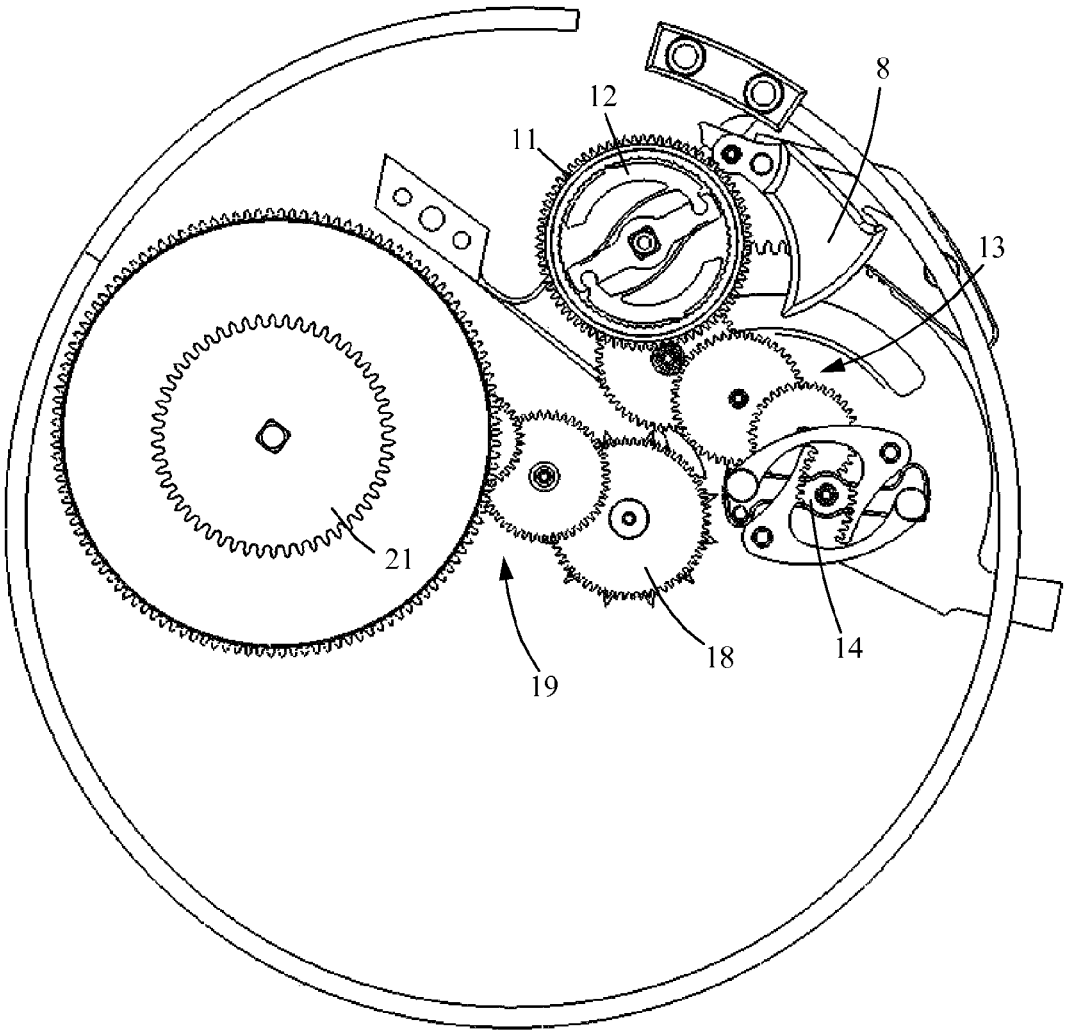

The features of the invention will appear more clearly after reading the description of a preferred embodiment, given only as an non-exhaustive example, by referring to schematic figures, in which:

FIG. 1 illustrates a plan view of the indicator device of the power reserve according to the invention, FIG. 2 illustrates a bottom view of the indicator device of the power reserve according to the invention.

According to the preferred embodiment of the invention, the watch movement according to FIG. 1 comprises a balance 1 arranged to rotate on a pin (not shown) when it is actuated. This balance 1 has an arm 2 which, when the movement is incorporated in a wristwatch, comes out from the middle of the casing and fits into a lock (not shown) that is arranged to slide onto the edge of the casing at a maximum angle of 25°. The balance 1 has on a part of its outline a rack 3 with a rack pinion 4 attached on a square part of the shaft 5 of a ring barrel 6 having a spiral (not shown), the ends of each of which are connected respectively to the shaft 5 and to the drum sleeve of the ring barrel 6. The latter features on its upper edge a striking mechanism ratchet 7 attached to the shaft 5. The ratchet 7 has a plurality of teeth, each tooth being arranged to actuate a hammer 8 by lifting a raiser 9 so that the hammer 8 strikes a gong 10.

According to FIG. 2, a ring wheel 11 is attached to the shaft 5 of the ring barrel 6 in such a way that it does not turn when the ring barrel 6 disarms. For this purpose, the ring wheel 11 is hollowed out and has on its internal circumference a Wolf's tooth which cooperates with two lipped pawls 12. This ring wheel 11, interlocks in addition with a multiplier gear train 13 which is engaged with a centrifugal type of speed regulator 14 to slow down the speed of the disarming of the ring barrel 6 in order to increase the time between each strike of the hammer 8 on the gong 10.

According to FIG. 1 the balance 1 has in addition a feeler-spindle 15 arranged to come up against a snail 16. The latter is attached to a star 17, which is driven by a wheel 18 interlocking with a differential gear train 19 engaged with the barrel 20 and linked kinematically to the rachet 21 of the watch movement.

The star 17 is indexed on the snail 16 and has twelve teeth. A jumper 22 acts on the tooth of the star 17 in order to position the snail 16 in a satisfactory position every time. Furthermore, the driving of the snail 16 by the wheel 18 is effected so as not to damage or prevent the mechanism from functioning when the star 17 jumps a tooth.

When the lock (not shown) is actuated to slide onto the edge of the casing of the wristwatch in which the movement according to the invention is incorporated, the course of the rack 3 corresponds to the power reserve since the feeler-spindle 15 is arranged to come up against the snail 16 of the power reserve. The rack 3 causes the rack pinion 4 to rotate, in order to accumulate the energy in the ring barrel 6 and to position the striking mechanism ratchet 7 so that a representative number of teeth of the power reserve are located upwards from the raiser 9.

When the lock of the balance 1 is released, the ring barrel 6 drives through its shaft the ring wheel 11, the rotational speed of which is regulated by the speed regulator 14 (FIG. 2). The striking mechanism ratchet 7, which is attached to the shaft of the ring barrel 6, is driven in rotation in order to actuate the raiser 9 across each of the teeth, in a way that said raiser 9 actuates in turn the hammer 8 so that this strikes the gong 10 a representative number of times of the power reserve.

According to the embodiment of the invention, the movement incorporating the device mentioned above has a power reserve of 108 hours. The gear ratios of the gear train have been determined so that the wheel 18 makes one rotation of 360° while the barrel 20 unwinds itself by making ten rotations. The star 17 is therefore driven 12 steps in 108 hours and as a result by one step every nine hours.

In this configuration the hammer 8 strikes the gong 10 twelve times when the indicating device of the power reserve is actuated and when between 99 hours and 108 hours of power reserve remains, eleven times when between 90 and 99 hours of power reserve remain, ten times when between 81 and 90 hours of power reserve remain, and so forth until the device strikes the gong one time to indicate a power reserve between 0 and 9 hours. It is understood that the number of times the hammer strikes the gong when the device is actuated may be different from the configuration mentioned above. For example, in an alternative advantageous embodiment of the invention, the device is adapted so that the hammer strikes the gong once a day when the power reserve remains.

The invention claimed is:

1. Watch movement of a mechanical or automatic watch comprising a device indicating the power reserve which is configured to enable the power reserve to be indicated on demand, characterised in that the device comprises means to produce an acoustic signal that indicates the amplitude of the power reserve when said means are actuated, and said means comprise a hammer (8) designed to strike a gong (10) a number of times that is representative of the power reserve, and a feeler-spindle (15) of the power reserve intended to come up against a snail (16) of the power reserve, the amplitude of the displacement of the feeler-spindle (15) being related to the power reserve at the moment when the feeler-spindle (15) is actuated for coming up against the snail (16).

2. Watch movement according to claim 1, characterised in that the snail (16) is rotated by a wheel (18) engaging with a differential gear train (19) with the barrel (20) and the ratchet (21) of the watch movement.

3. Watch movement according to claim 1, characterised in that said means include in addition a rack (3) designed to be displaced as a result of the movement of the feeler-spindle (15), the rack (3) coming up against or able to come up against a rack pinion (4) attached to the shaft (5) of a striking mechanism barrel (6), said means comprising in addition a striking mechanism ratchet (7) arranged on the striking mechanism barrel (6), said ratchet (7) comprising a plurality of teeth that each can actuate the hammer (8) against the gong (10).

4. Watch movement according to claim 1, characterised in that said means comprise a balance (1) comprising an operable part (2), said balance (1) being arranged to pivot at an angle relative to the amplitude of the power reserve when said part (2) is actuated.

5. Wristwatch comprising the watch movement according to claim 1.

6. Wristwatch comprising the watch movement according to claim 4, characterised in that the operable part (2) of the balance (1) is arranged on the outside of the watch case and is able to be displaced over a circular segment along the case.

* * * * *